US007636954B2

(12) United States Patent
Lang-Ree et al.

(10) Patent No.: US 7,636,954 B2
(45) Date of Patent: Dec. 29, 2009

(54) SYSTEM FOR ACCOMMODATING HELMET ACCESSORIES

(75) Inventors: Arne Lang-Ree, Los Gatos, CA (US); Hilgard N. Muller, Felton, CA (US)

(73) Assignee: Bell Sports, Inc., Irving, TX (US)

( * ) Notice: Subject to any disclaimer, the term of this patent is extended or adjusted under 35 U.S.C. 154(b) by 997 days.

(21) Appl. No.: 10/911,246

(22) Filed: Aug. 3, 2004

(65) Prior Publication Data

US 2006/0026741 A1 Feb. 9, 2006

(51) Int. Cl.
*A42B 1/24* (2006.01)

(52) U.S. Cl. ..... 2/422; 2/410

(58) Field of Classification Search ..... 2/195.5, 2/DIG. 8, 209.14, 175.1, 209.13, 422, 10; 359/880, 855, 879; 248/477, 479, 481; 351/50
See application file for complete search history.

(56) References Cited

U.S. PATENT DOCUMENTS

| | | | | | |
|---|---|---|---|---|---|
| 256,393 | A | * | 4/1882 | Shone | 351/155 |
| 582,724 | A | * | 5/1897 | Dromgoole | 248/479 |
| 1,358,551 | A | * | 11/1920 | Hosford | 2/181.4 |
| 1,833,741 | A | * | 11/1931 | Diehl | 2/10 |
| 2,445,203 | A | * | 7/1948 | Bowers | 2/10 |
| 2,655,657 | A | * | 10/1953 | Lueders | 2/12 |
| 2,788,523 | A | * | 4/1957 | Seguin | 2/12 |
| 3,273,163 | A | * | 9/1966 | Andrews, III | 2/422 |
| 3,804,495 | A | * | 4/1974 | Rayow et al. | 359/834 |
| 3,988,058 | A | * | 10/1976 | Chaney et al. | 359/880 |
| 4,639,950 | A | * | 2/1987 | Palmaer | 2/422 |
| 4,793,007 | A | * | 12/1988 | Barnett | 2/422 |
| 5,007,141 | A | | 4/1991 | Gentes | 24/163 R |
| 5,099,523 | A | | 3/1992 | Broersma | 2/411 |
| 5,119,516 | A | | 6/1992 | Broersma | 2/411 |
| 5,269,025 | A | | 12/1993 | Broersma | 2/411 |
| 5,351,341 | A | | 10/1994 | Broersma | 2/412 |
| 5,469,583 | A | | 11/1995 | Akeley et al. | 2/421 |
| 5,477,563 | A | | 12/1995 | Gentes et al. | 2/411 |
| 5,481,762 | A | | 1/1996 | Gentes et al. | 2/411 |
| 5,508,900 | A | * | 4/1996 | Norman | 362/106 |
| 5,658,065 | A | * | 8/1997 | Jamieson | 362/106 |
| 5,659,900 | A | | 8/1997 | Arney et al. | 2/417 |
| 5,667,292 | A | * | 9/1997 | Sabalvaro, Jr. | 362/106 |
| 5,675,843 | A | | 10/1997 | Grim et al. | 2/422 |
| 5,704,072 | A | * | 1/1998 | Garneau | 2/421 |
| 5,729,877 | A | | 3/1998 | Kong et al. | 24/625 |
| 5,764,335 | A | * | 6/1998 | Berke | 351/50 |
| 5,774,901 | A | * | 7/1998 | Minami | 2/421 |
| 5,887,288 | A | | 3/1999 | Arney et al. | 2/421 |

(Continued)

FOREIGN PATENT DOCUMENTS

GB 2104236 A * 3/1983

(Continued)

*Primary Examiner*—Gary L Welch
*Assistant Examiner*—Andrew W Sutton
(74) *Attorney, Agent, or Firm*—Baker Botts L.L.P.

(57) ABSTRACT

According to one embodiment of the invention, a helmet attachment system is provided. The system includes a helmet. The system also includes a platform coupled to the helmet. The platform has a length, a width, and a thickness. The platform is configured to allow a device to be coupled to the helmet.

16 Claims, 6 Drawing Sheets

U.S. PATENT DOCUMENTS

| | | | | |
|---|---|---|---|---|
| 5,917,667 | A * | 6/1999 | Turner | 359/880 |
| 5,970,585 | A * | 10/1999 | Scholey | 24/482 |
| 6,009,561 | A | 1/2000 | Bullock et al. | 2/422 |
| 6,009,562 | A | 1/2000 | Bullock et al. | 2/422 |
| 6,206,530 | B1 * | 3/2001 | Eberts | 359/879 |
| 6,247,824 | B1 * | 6/2001 | Berke et al. | 359/880 |
| 6,401,261 | B1 | 6/2002 | Arney et al. | 2/421 |
| 6,449,776 | B1 | 9/2002 | Musal | 2/418 |
| 6,497,493 | B1 * | 12/2002 | Theisen | 362/105 |
| 6,616,294 | B1 * | 9/2003 | Henry | 362/106 |
| 6,681,403 | B2 * | 1/2004 | Lyden | 2/22 |
| 6,754,911 | B1 * | 6/2004 | Howell | 2/422 |
| 6,996,852 | B1 * | 2/2006 | Cabrera | 2/172 |

FOREIGN PATENT DOCUMENTS

| | | | |
|---|---|---|---|
| WO | WO 9101509 | A1 * | 2/1991 |

* cited by examiner

SYSTEM FOR ACCOMMODATING HELMET ACCESSORIES

TECHNICAL FIELD OF THE INVENTION

This invention relates generally to protective gear and more particularly to a system for accommodating helmet accessories.

BACKGROUND OF THE INVENTION

A physical impact to the head of a person may cause serious injury or death. To reduce the probability of such consequences, protective gear, such as a helmet, is often used in activities that are associated with an increased level of risk for a head injury. Examples of such activities include, but are not limited to, skiing, snowboarding, bicycling, rollerblading, rock climbing, skate boarding, and motorcycling. The level of safety may be increased when a person wears a helmet and also uses one or more accessories that are designed to increase the probability of avoiding an accident.

SUMMARY OF THE INVENTION

According to one embodiment of the invention, a mirror attachment for a helmet is provided. The helmet has a visor that defines a recess. The mirror attachment includes a base operable to be nested substantially within the recess of the visor and to be coupled to the visor. The mirror attachment also includes a mirror rotatably coupled to the base. The mirror is operable to move between a storage configuration and an extended configuration by being rotated. The mirror and the base, when in the storage configuration, comprise a combined footprint that fits substantially within a footprint of the recess.

According to another embodiment of the invention, a helmet attachment system is provided. The system includes a helmet having a rear portion. The system also includes a platform coupled to the rear portion. The platform has a length, a width, and a thickness. The platform is configured to allow a device to be coupled to the rear portion of the helmet.

Some embodiments of the invention provide numerous technical advantages. Other embodiments may realize some, none, or all of these advantages. For example, in certain embodiments, accessories may be more conveniently and securely coupled to the helmet by providing a platform on the helmet configured to receive at least one accessory. In certain embodiments, a rear view mirror is made more accessible to a user of a helmet by configuring a mirror assembly to be retracted and nested at least partially within a recess defined by a visor of the helmet. In certain embodiments, accessories having a clip as a coupling mechanism may be conveniently and securely coupled to the rear portion of a helmet by providing a platform that is configured to receive the clip.

Other advantages may be readily ascertainable by those skilled in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF EXAMPLE EMBODIMENTS OF THE INVENTION

Embodiments of the invention are best understood by referring to FIGS. 1 through 6B of the drawings, like numerals being used for like and corresponding parts of the various drawings.

Figure 1:
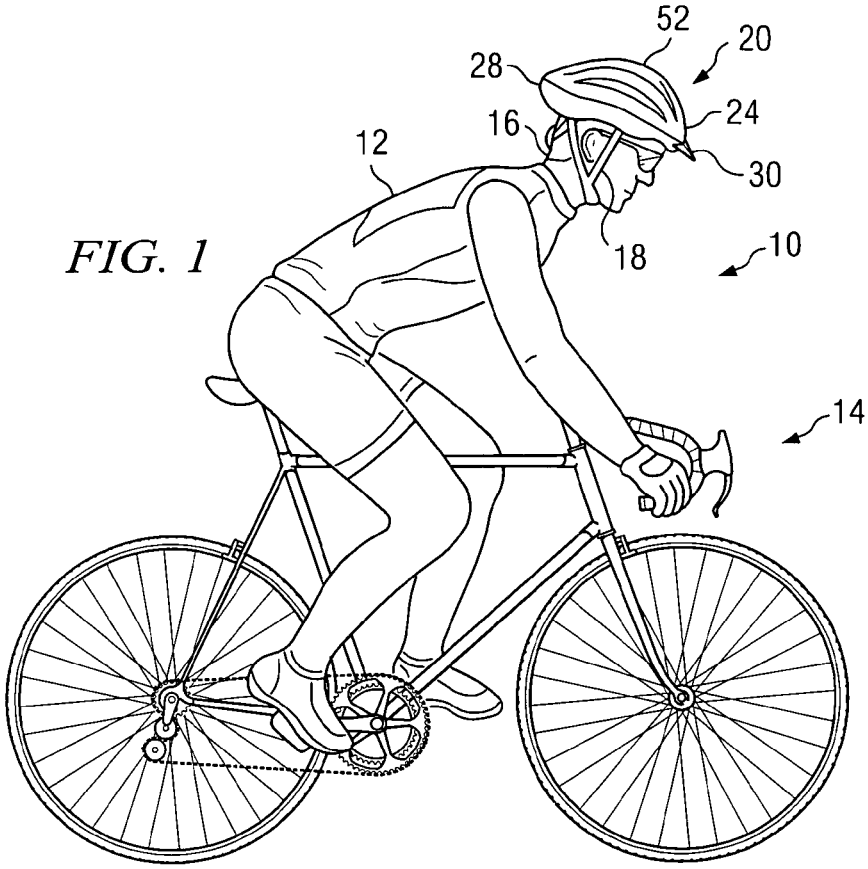
FIG. 1 is a schematic diagram illustrating one embodiment of an environment in which a helmet may be used.

FIG. 1 is a schematic diagram illustrating one example of an environment 10 in which head gear 20 according to one or more embodiments of the present invention may be used. As shown in FIG. 1, environment 10 includes a bicyclist (user) 12 riding a bicycle 14 wearing head gear 20 on a head 16 of user 12. Head gear 20 is secured to head 16 of user 12 through the use of straps 18. One example of head gear 20 is a helmet, and for illustrative purposes, a helmet 20 is used as an example of head gear 20. Helmet 20 comprises a helmet body 52, a front portion 24, a rear portion 28, and a visor 30 coupled to front portion 24. The term "helmet," as used herein, includes any type of protective head gear, such as a bicycle helmet, a motorcycle helmet, and a hard hat. Although helmet 20 is used as an example to describe some embodiments of the invention, any type of head gear, both protective and non-protective, may benefit from the teachings of the present invention.

Referring again to FIG. 1, if user 12 were to fall off of bicycle 14 due to an accident, user 12 may suffer various injuries, including an impact to head 16. Because the use of a protective head gear such as helmet 20 may reduce the severity of trauma to head 16 in case of an impact, the use of helmet 20 is strongly encouraged for many activities where the probability of injury to head 16 is relatively high. In conjunction with helmet 20 which may reduce the severity of injury to user 12, user 12 may also benefit from accessories that may decrease the probability of an event that may lead to an injury of user 12 or that may otherwise provide comfort or convenience to user 12. For example, a tail light or reflector may be used so that user 12 is more visible to others, such as a driver of a car. In another example, user 12 may use a rear view mirror to conveniently see those who may approach user 12 from the rear.

According to some embodiments of the present invention, a system for enhancing safety, comfort, and/or convenience is provided by providing one or more platforms on the helmet that are configured to receive accessories. In some embodiments, a rear view mirror is made more accessible and less obtrusive to a user of a helmet by configuring a mirror assembly to be retracted and nested at least partially within a recess defined by a visor of the helmet. In some embodiments, a reflective face of a mirror is protected by configuring a mirror assembly to assume a retracted configuration with the reflective face oriented toward a recess in which the retracted mirror assembly is at least partially nested. In other embodiments, accessories having a clip as a coupling mechanism may be conveniently and securely coupled to the rear portion of a helmet by providing a platform that is configured to receive the clip. Additional details of example embodiments of the invention are described below in greater detail in conjunction with FIGS. 2-6B.

Figure 2:
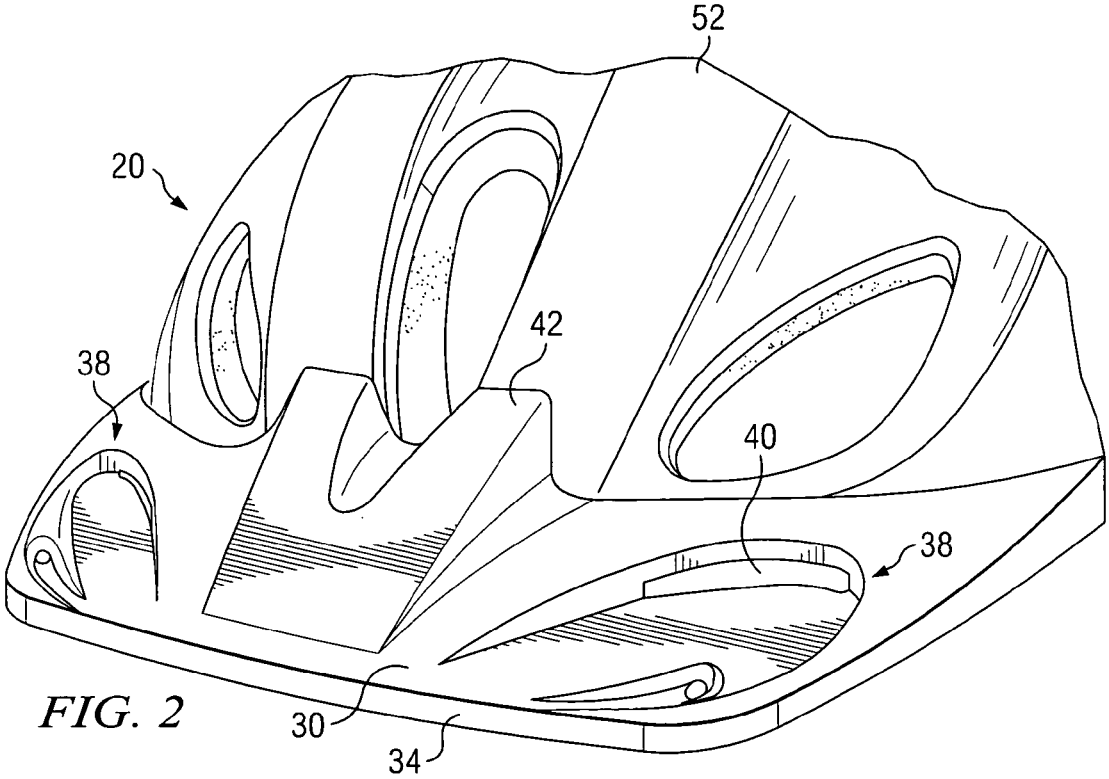
FIG. 2 is a schematic diagram illustrating a perspective view of one embodiment of a visor of the helmet shown in FIG. 1.

FIG. 2 is a schematic diagram illustrating a perspective view of one embodiment of visor 30 shown in FIG. 1. Visor 30 comprises an outer surface 42 and a lip 34. According to some embodiments of the invention, visor 30 defines one or more recesses 38 at outer surface 42. As shown in FIG. 2, one recess 38 may be defined at each side of visor 30; however, one or more recesses 38 may be defined by visor 30 in any shape and size depending on the footprint of a mirror assembly or other accessory (not explicitly shown in FIG. 2) to be nested in recess 38 when the mirror assembly is in a storage configuration. Additional details concerning the mirror assembly are provided below in conjunction with FIGS. 3A-5B. Referring again to FIG. 2, although FIG. 2 shows recess 38 as having a partial oval shape, recess 38 may comprise any suitable shape, such as rectangle or a polygon or portions thereof. In certain embodiments, as shown in FIG. 2, each recess 38 defines a slot 40 that may be used to secure the mirror assembly to visor 30, as described in further detail below. Providing recess 38 on visor 30 is advantageous in some embodiments because recess 38 may be used as an area where an accessory, such as a mirror assembly, is coupled to visor 30 and stored when not in use.

Figure 3A:
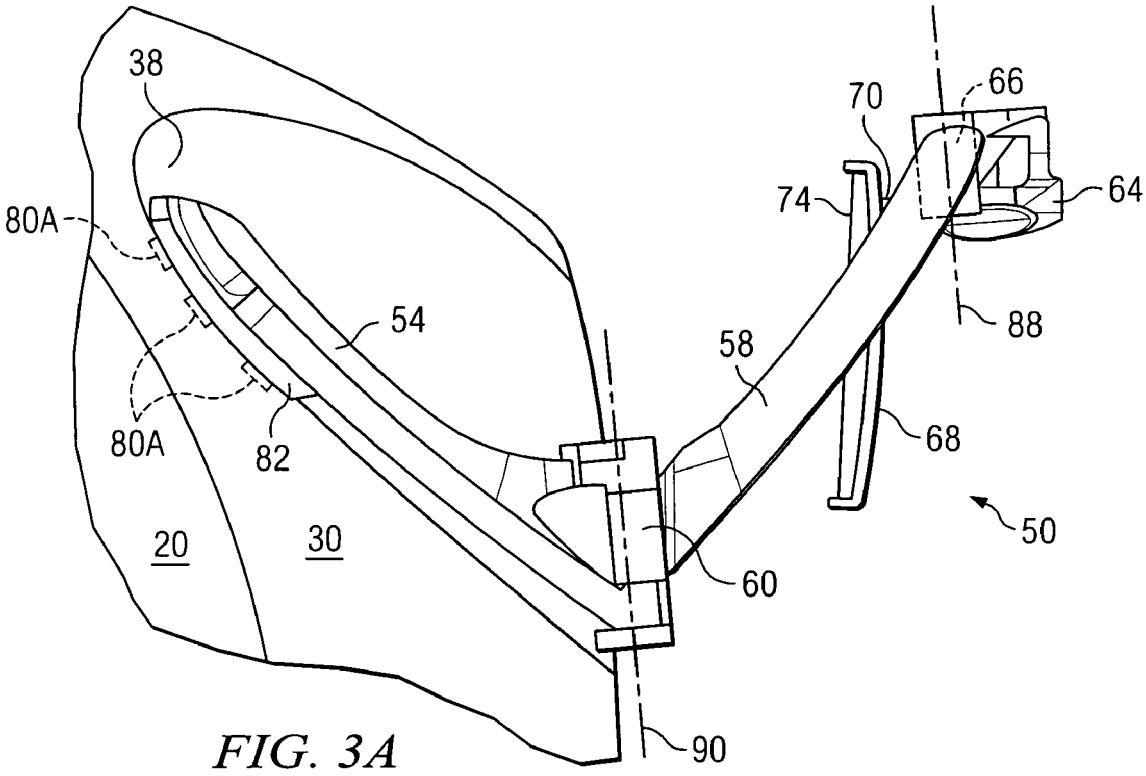
FIGS. 3A and 3B are schematic diagrams illustrating a top view and a side view, respectively, of a mirror assembly that may be used in conjunction with the visor shown in FIG. 2.
Figure 3B:
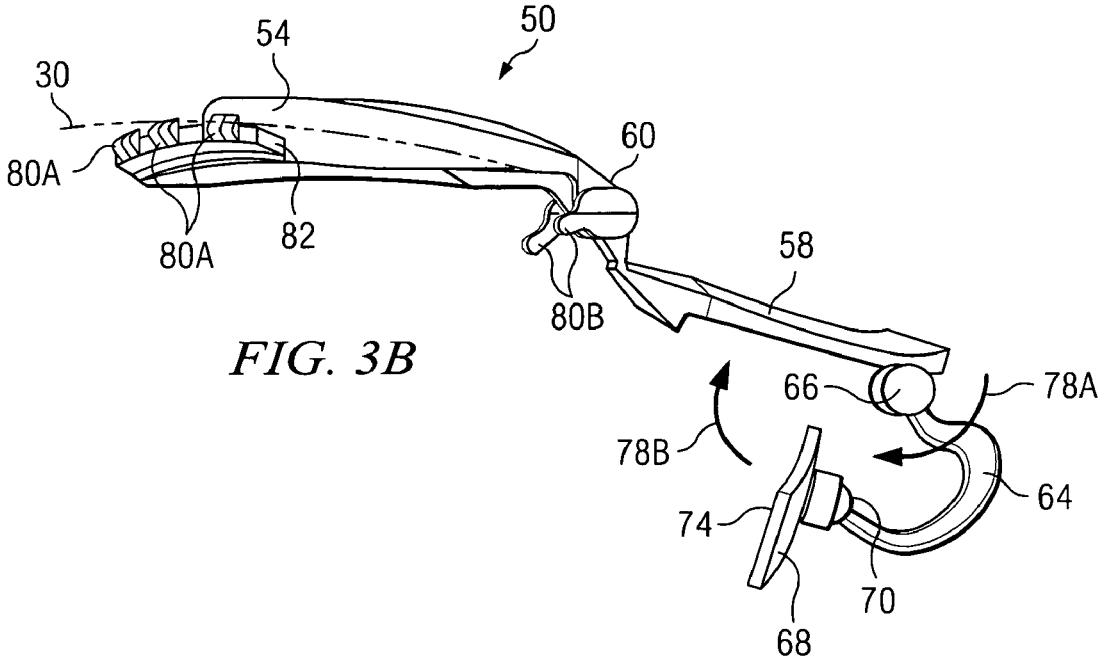

FIGS. 3A and 3B are schematic diagrams illustrating a top view and a side view, respectively, of a mirror assembly 50 in an extended configuration. Mirror assembly 50 may be used in conjunction with visor 30 of helmet 20. Referring to both FIGS. 3A and 3B, in certain embodiments, mirror assembly 50 comprises a base 54, a joint 60, an arm 58, a joint 66, an arm 64, a joint 70, and a mirror 68. Base 54 is coupled to arm 58 through joint 60, and arm 58 is coupled to arm 64 through joint 66. Mirror 68 is coupled to arm 64 through joint 70. Base 54 comprises a flange 82 and one or more toes 80A that extend from flange 82. One or more fingers 80B may be provided that are configured to deform elastically and snap over lip 34 of visor 30 (shown in FIG. 2). In some embodiments, fingers 80B may be rotatably coupled to joint 60 and may be spring-loaded. Mirror 68 comprises a reflective face 74, and is shaped so that when mirror assembly 50 is in a storage configuration, mirror 68 will fit within the footprint of recess 38.

In certain embodiments, joint 60 may be a pivot joint that allows arm 58 to rotate around an axis 90, and joint 66 may be a pivot point that allows arm 64 to rotate around an axis 88. Joint 70 may be a ball joint. Although joints 60, 66, and 70 are described as particular types of joints, any suitable joint, hinge, or any other device that allows rotational movement of arms 58, 64, and mirror 68 may be used as joints 60, 66, or 70, depending on the particular design of mirror assembly 50. For example, joint 66 may be a ball joint and joint 70 may be a pivot joint. Although one example of mirror assembly 50 that is operable to assume an extended configuration and a storage configuration is described above, the size, shape, and number of arms in mirror assembly 50 may vary depending on the particular design of mirror assembly 50.

Flange 82 and toes 80A of base 54 may be used to couple base 54 to recess 38 of visor 30 (shown as a phantom line in FIG. 3B). For example, the tips of toes 80A and flange 82 are first inserted into slot 40 shown in FIG. 2, and then base 54 is rotated downward to hook toes 80A through slot 40. Then fingers 80B are positioned under lip 34 of visor 30 to secure base 54 in recess 38, as base 54 is positioned substantially flat within recess 38. Thus, toes 80A and fingers 80B cooperate to secure base 54 in recess 38. Although one mechanism for securing base 54 to recess 38 is described by way of example, any suitable coupling mechanism may be used to couple base 54 to recess 38. Referring to FIG. 3A, in some embodiments, base 54 may conform at least partially to the footprint of recess 38. This is advantageous in certain embodiments because such a shape allows mirror assembly 50 to remain compact when in a storage configuration.

As shown in FIG. 3A, in some embodiments, arm 58 and base 54 are positioned so that they are approximately symmetrical in orientation. This is advantageous in certain embodiments because when arm 58 is rotated at joint 60 towards base 54, arm 58 may substantially overlap base 54, which enhances the compactness of mirror assembly 50 when in a storage configuration. Further, as shown in FIG. 3A, base 54 and arm 58 may together form an approximate "V" or "U" shape when in an extended configuration. This is advantageous in certain embodiments because when base 54 is nested in recess 38 as shown in FIG. 3A, arm 58 extends to a side of user 12 so that reflective face 74 of mirror 68 is positioned to the side of the face of user 12. Such a positioning allows user 12 to better view the events occurring at the rear of user 12.

Mirror assembly 50 is operable to assume a retracted configuration, also referred to as a storage configuration, so that a substantial portion of mirror assembly 50 is at least partially nested within recess 38. For example, from a fully extended orientation as shown in FIGS. 3A and 3B, mirror 68 is operable to be rotated at joint 70 to assume an orientation to rest under arm 58 when arm 64 is rotated at joint 66. Arm 64 is operable to be rotated at joint 66, as shown by an arrow 78A, so that mirror 68 coupled to arm 64 may be nested under arm 56 with reflected face 74 oriented toward the underside of arm 58. The movement of mirror 68 due to this rotation of arm 64 is indicated by an arrow 78B in FIG. 3B. After mirror 68 and arm 64 are rotated as described above, mirror assembly 50 is in a partially retracted configuration, as illustrated in FIGS. 4A and 4B.

Figure 4A:
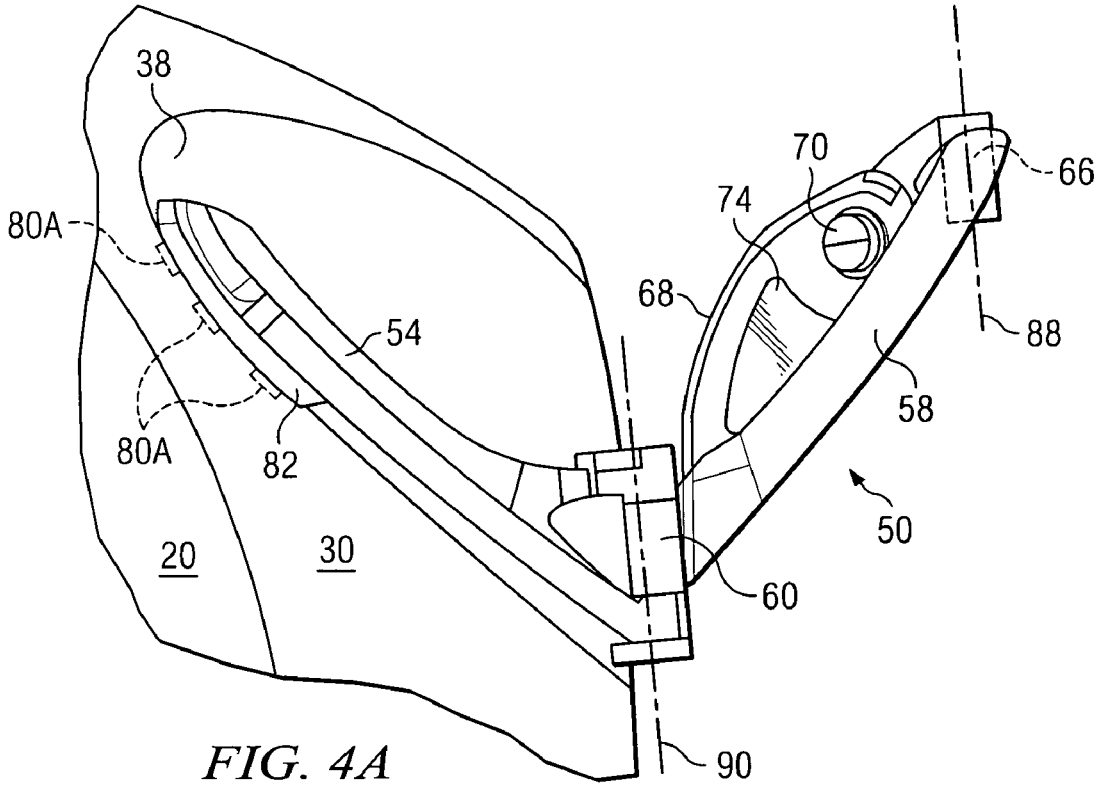
FIGS. 4A and 4B are schematic diagrams illustrating a top view and a side view, respectively, of the mirror assembly shown in FIGS. 3A through 3B in a partially retracted configuration.
Figure 4B:
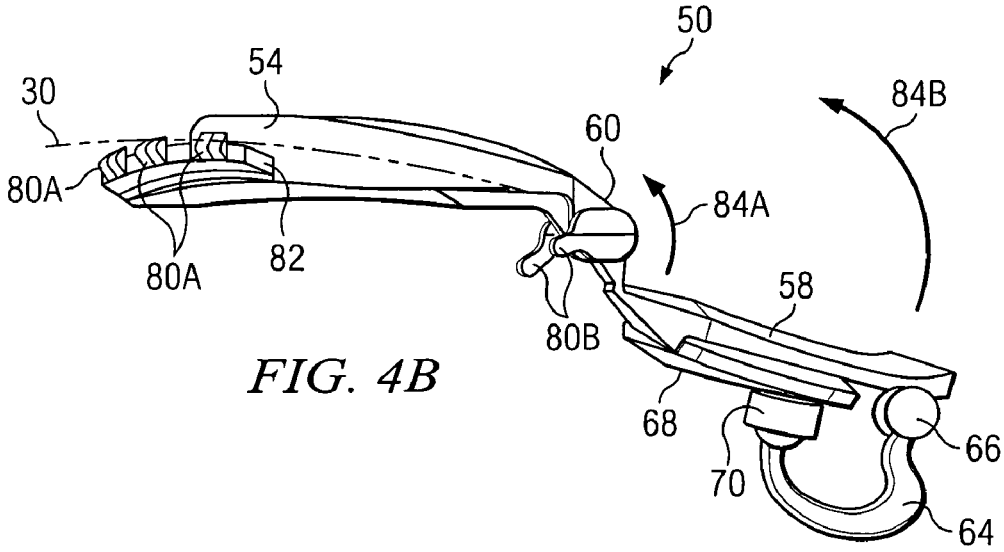

FIGS. 4A and 4B are schematic diagrams illustrating a top view and a side view, respectively, of mirror assembly 50 shown in FIGS. 3A through 3B in a partially retracted configuration. Referring to and as shown in FIGS. 4A and 4B, mirror 68 is positioned under arm 58. After arm 64 has been rotated at joint 66, arm 58 is rotated at joint 60 in a direction shown by arrows 84A and 84B so that arm 58, mirror 68, and arm 64 may be positioned over base 54 and stowed, as illustrated in FIGS. 5A and 5B.

Figure 5A:
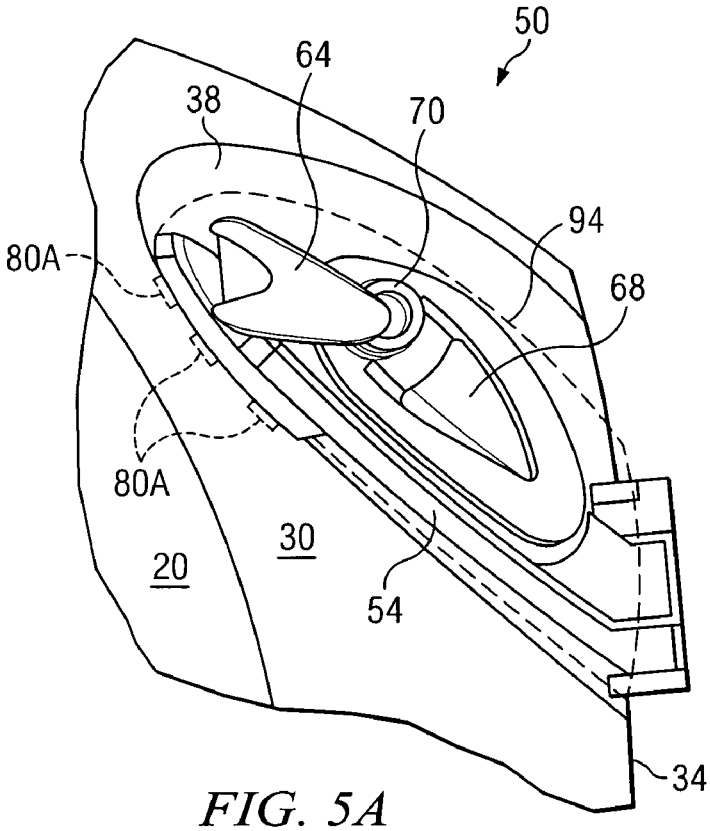
FIGS. 5A and 5B are schematic diagrams illustrating a top view and a side view, respectively, of the mirror assembly shown in FIGS. 3A through 4B in a retracted configuration.
Figure 5B:
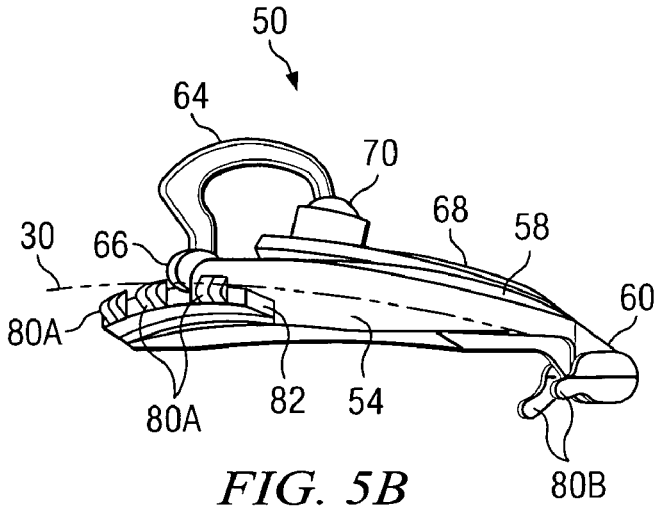

FIGS. 5A and 5B are schematic diagrams illustrating a top view and a side view, respectively, of mirror assembly 50 shown in FIGS. 3A through 4B in a retracted or storage configuration. As shown in FIGS. 5A and 5B, when arm 58 is rotated at joint 60, arm 58 is positioned over base 54 and assumes a compact configuration having a footprint 94 that fits within recess 38. As shown in FIG. 5A, footprint 94 has approximately the same shape as the footprint of recess 38. In some embodiments, reflective face 74 faces toward base 54 and recess 38 when mirror assembly 50 is in a storage configuration, as shown in FIGS. 5A and 5B. This is advantageous in certain embodiments because reflective face 74 is protected from damage in storage configuration. Further, in certain embodiments, the approximately symmetrical orientation and shape of arm 58 and base 54 allows arm 58 and base 54 to approximately overlap one another, which allows mirror assembly 50 in a storage configuration to have a more compact footprint, as shown in FIG. 5A.

Although certain embodiments of mirror assembly 50 are described using FIGS. 3A-5B, mirror assembly 50 may comprise more or less components having different sizes, shapes, and configuration so that mirror assembly 50 may be coupled to recess 38 of visor 30, extend from recess 38 to present mirror 68 to user 12, and retract onto recess 38 to assume a storage configuration. For example, base 54 may comprise a hollow case that allows an arm to be stored within the hollow case. The arm may be operable to rotate downward when the arm is extended out from the hollow case. A mirror may be coupled to the other end of the arm and may be rotated to present the mirror to a user.

Figure 6A:
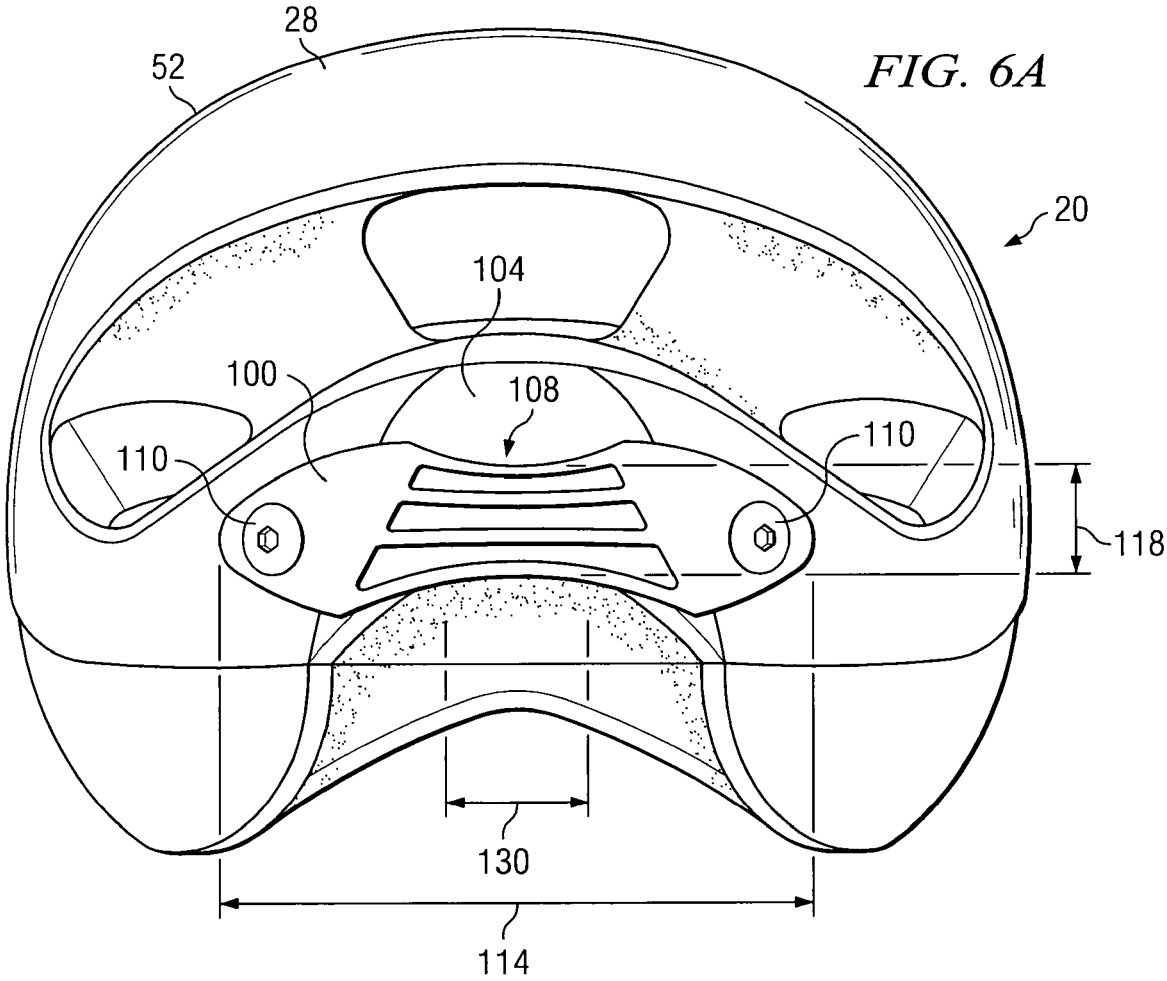
FIG. 6A is a schematic diagram illustrating a front view of an accessory platform that is mounted on the rear portion of the helmet shown in FIG. 1.
Figure 6B:
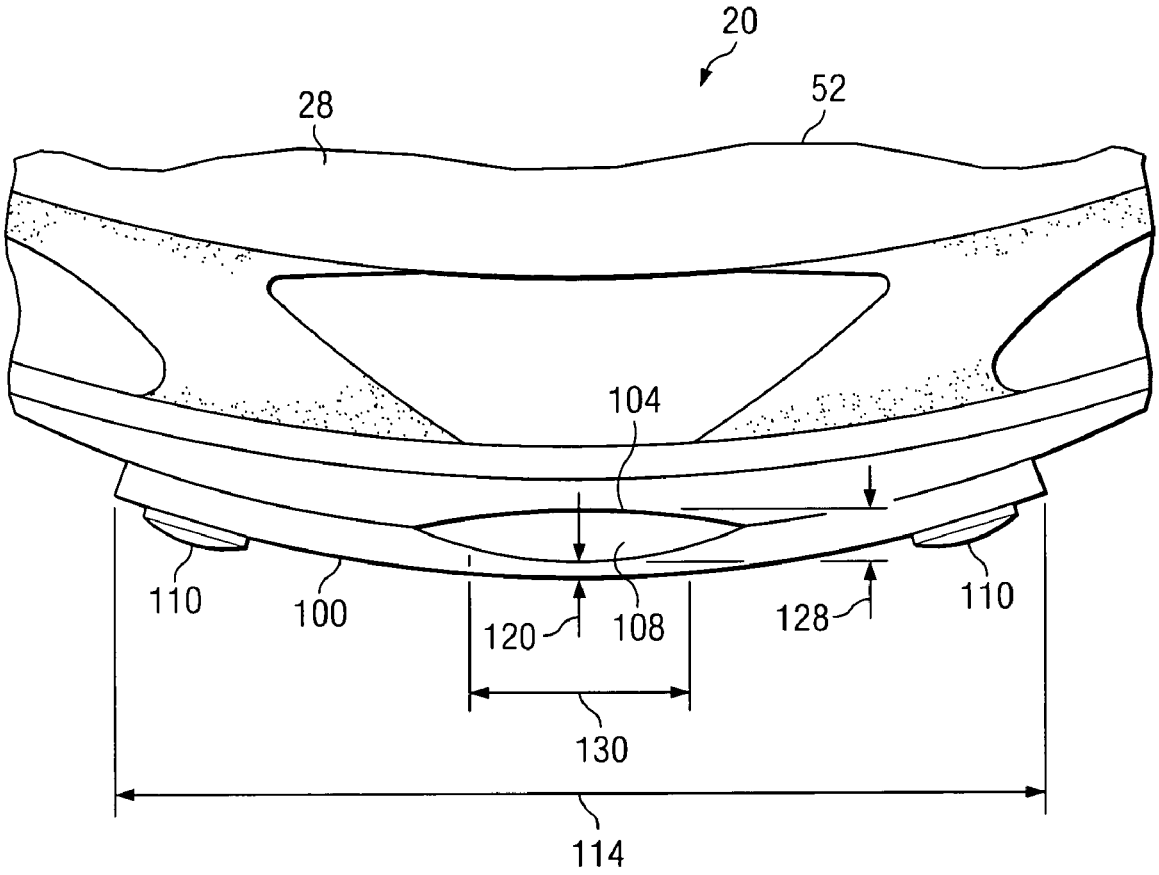
FIG. 6B is a schematic diagram illustrating a top view of the accessory platform shown in FIG. 6A.

FIG. 6A is a schematic diagram illustrating a front view of an accessory platform 100 that is mounted on rear portion 28 of helmet 20. FIG. 6B is a schematic diagram illustrating a top view of accessory platform 100 shown in FIG. 6A. Referring to FIG. 6A, platform 100 having a length 114, a width 118, and a thickness 120 (as shown in FIG. 6B) and configured to support an accessory for helmet 20 is coupled to body 52 of helmet 20. Although FIGS. 6A and 6B shows the use of bolts 110 as a mechanism for coupling platform 100 to body 52 of helmet 20, any suitable method may be used to couple belt 100 to helmet 20. An example of platform 100 is a belt 100, and for illustrative purposes, platform 100 is referred to as belt 100; however, any suitable platform that is operable to facilitate the coupling of an accessory, such as a light or reflector having a clip as an attachment mechanism, may be platform 100.

Referring to FIG. 6B, belt 100 and/or body 52 of helmet 20 is configured so that a gap 108 having a gap height 128 and a gap width 130 is formed between body 52 of helmet 20 and belt 100. As used herein, "gap width," such as gap width 130, refers to the portion of the width of gap 108 that has sufficient gap height 128 to allow an attachment mechanism of an accessory to be inserted into gap 108 and secured to belt 100. As shown in FIG. 6B, in certain embodiments, body 52 may define a depression 104 at a location of helmet 20 where belt 100 may be positioned. For example, depression 104 may be formed at rear portion 28 of helmet 20, and belt 100 may be positioned over depression 104. In doing so, gap 108 is formed. Although belt 100 is described as being provided at rear portion 28 of helmet 20 in certain embodiments, belt 100 may be provided at any suitable location of helmet 20. For example, belt 100 may be provided at front portion 24 of helmet 20 to accommodate a clip-on headlight. Accessories that are configured to be used in conjunction with helmet 20 may be coupled to belt 100 in a variety of ways. For example, where the accessory to be coupled to helmet 20 is a tail light, reflector, or other device that has a clip as an attachment mechanism, the tongue of the clip may be inserted through gap 108 so that the accessory is clipped on to belt 100.

Referring to FIGS. 6A and 6B, gap 108 may be formed using other configurations of belt 100 and body 52. For example, even without forming depression 104, belt 100 may be coupled to body 52 of helmet 20 in such a way that the center portion of belt 100 bulges out from body 52. This may be accomplished by decreasing the distance between bolts 110 so that belt 100 bulges outwardly from body 52 and thus forming gap 108 between body 52 and belt 100. In some embodiments, belt 100 may be shaped so that the center portion is offset from the end portions so that when the end portions are fastened to body 52, the offset center portion is suspended over body 52, forming gap 108. In some embodiments, belt 100 may be formed as an integral part of body 52 of helmet 20. In certain embodiments, gap 108 may be formed by platform 100 independently rather than with body 52.

In some embodiments, belt 100 may be formed from a suitable flexible material, such as a thermoplastic elastomer. An example of thermoplastic elastomer is SANTOPRENE, available from Advanced Elastomers, Inc. Using a flexible material to form platform 100 is advantageous in certain embodiments because any vibration transferred from an accessory, such as a tail light, may be absorbed by belt 100.

Referring again to FIGS. 6A and 6B, in certain embodiments, length 114, width 118, thickness 120, gap height 128, and gap width 130 may be adjusted to accommodate a particular dimension of an attachment mechanism of an accessory. For example, where an accessory having a clip as an attachment mechanism is the accessory to be coupled to helmet 20, the physical dimensions of belt 100 and gap 108 may be adjusted so that the clip can securely engage belt 100. For example, width 118 may be in the range of approximately 22-40 millimeters, approximately 22-34 millimeters, approximately 26 millimeters, approximately 27 millimeters, approximately 32 millimeters, or approximately 40 millimeters, depending on the physical dimensions of the clip of accessories to be coupled to platform 100. Gap width 130 may be in the range of approximately 20-22 millimeters, or greater than or equal to the following dimensions depending on the physical dimensions of the clip of accessories to be coupled to platform 100: Approximately 20 millimeters, approximately 21 millimeters, or approximately 22 millimeters. Thickness 120 may be in a range of approximately 2-4 millimeters, or approximately 2-3 millimeters, depending on the physical dimensions of the clip of accessories to be coupled to platform 100. As shown in FIGS. 6A and 6B, length 114, width 118, thickness 120, gap height 128, and gap width 130 may vary depending on the particular location of belt 100. The example ranges of dimensions provided above are directed to an area of belt 100 that may receive an accessory. For example, as shown in FIGS. 6A and 6B, the center portion of belt 100 may be such an area of belt 100.

Belt 100 having the example physical dimensions described above may accommodate many different types of accessories that may be manufactured to be used in conjunction with a helmet, such as helmet 20. However, the particular physical dimensions of belt 100 and gap 108 may be adjusted in any way to accommodate a particular attachment mechanism of an accessory. For example, the physical size of depression 104 may be adjusted to increase or decrease the size of gap 108.

Although some embodiments of the present invention have been described in detail, it should be understood that various changes, substitutions, and alterations can be made hereto without departing from the spirit and scope of the invention as defined by the appended claims.

What is claimed is:

1. A mirror attachment for a helmet having a visor, the visor defining a recess, the system comprising:

a base operable to be nested substantially within the recess of the visor and to be coupled to the visor; and a mirror rotatably coupled to the base and operable to move between a storage configuration and an extended configuration by being rotated, wherein the mirror is operable to assume a storage configuration by being rotated to be positioned at least partially over the base, wherein the mirror and the base, when in the storage configuration, comprise a combined footprint that fits substantially within a footprint of the recess.

2. The mirror attachment of claim 1, and further comprising a ball joint coupling the mirror and the base.

3. The mirror attachment of claim 1, and further comprising an arm coupling the base and the mirror, the arm operable to be positioned at least partially over the base when the mirror assumes the storage configuration.

4. The mirror attachment of claim 1, wherein the mirror comprises a reflective face and is operable to assume the storage configuration by being rotated so that the reflective face is oriented substantially toward the base.

5. The mirror attachment of claim 1, wherein the mirror is rotatably coupled to the base through a first arm and a second arm, the first arm having a first end and a second end, the second arm having a third end and a fourth end, the first end rotatably coupled to the mirror and the second end rotatably coupled to the third end of the second arm, and wherein the fourth end of the second arm is rotatably coupled to the base.

6. A helmet mirror system, comprising:

a helmet;

a visor coupled to the helmet and defining a recess;

a base operable to be nested substantially within the recess of the visor and to be coupled to the visor;

an arm rotatably coupled to the base through a first joint; and a mirror coupled to the arm through a second joint, the mirror operable to move between a storage configuration and an extended configuration by being rotated around the first and the second joints and positioned at least partially over the base, wherein the mirror and the base, when in the storage configuration, comprise a combined footprint that fits substantially within a footprint of the recess.

7. The helmet mirror system of claim 6, wherein the second joint is a ball joint.

8. The helmet mirror system of claim 6, wherein the mirror comprises a reflective face and is operable to assume the storage configuration by being rotated around the first and the second joints so that when the mirror is positioned at least partially over the base, the reflective face is substantially oriented toward the base.

9. The helmet mirror system of claim 6, wherein the arm is a first arm, and further comprising a second arm rotatably coupling the first arm to the base, the second arm operable to be positioned over the base when the mirror assumes the storage configuration.

10. A helmet attachment system, comprising:

a helmet having an exterior surface, the exterior surface of the helmet defining a depression; and a belt comprising a length, a width, and a thickness, wherein:

the belt is fixed to the exterior surface;

the belt is disposed over a substantial portion of the depression to define a gap between the belt and the depression, wherein the gap is sized to receive a portion of a device for coupling the device to the exterior surface of the helmet; and the belt and the gap are configured to allow a device to be coupled to the exterior surface of the helmet.

11. The helmet attachment system of claim 10, wherein the thickness is sized to receive a portion of a device for coupling the device to the exterior surface of the helmet.

12. The helmet attachment system of claim 10, wherein the gap is configured to allow a device to be coupled to the exterior surface of the helmet by being sized to receive a tongue of a clip attached to the device.

13. The helmet attachment system of claim 10, wherein the belt is formed from a flexible material.

14. The helmet attachment system of claim 10, wherein the belt is formed from a thermoplastic elastomer.

15. The helmet attachment system of claim 10, wherein the belt is formed from SANTOPRENE.

16. The helmet attachment system of claim 10, wherein the width is approximately 22-40 millimeters and the thickness is approximately 2-4 millimeters.

* * * * *